US005626418A

United States Patent [19]

Angelis, Sr. et al.

[11] Patent Number: 5,626,418

[45] Date of Patent: May 6, 1997

[54] FLEXIBLE OUTDOOR LIGHTING STAND

[76] Inventors: David Angelis, Sr.; David L. Angelis, Jr., both of 18 Bremen Lane, Mississauga, Ontario, Canada, L5M 1G6

[21] Appl. No.: 632,112

[22] Filed: Apr. 15, 1996

[51] Int. Cl.[6] ..... F21J 15/04

[52] U.S. Cl. ..... 362/390; 362/431; 248/160

[58] Field of Search ..... 362/390, 431, 362/369; 248/548, 156, 160, 900

[56] References Cited

U.S. PATENT DOCUMENTS

| | | | |
|---|---|---|---|
| 2,082,272 | 6/1937 | Zinhow | 248/160 |
| 2,254,566 | 9/1941 | Cornell | 248/160 |
| 4,996,636 | 2/1991 | Lovett | 362/431 |
| 5,526,243 | 6/1996 | Masters | 362/122 |

*Primary Examiner*—Carroll B. Dority

[57] ABSTRACT

A flexible outdoor lighting stand including a rigid stake member that has a tapered point at a lower end for piercing the ground and an upper end. A generally cylindrical flexible post member having a lower sleeve positionable over the upper end of the stake member. The post member has spring member coupled to the lower sleeve. The spring member has an upper sleeve coupled therewith. Lastly, the upper sleeve of the post member has a lighting adaptor capable of coupling with a light source when the lower sleeve is positioned over the stake member.

5 Claims, 3 Drawing Sheets

FLEXIBLE OUTDOOR LIGHTING STAND

BACKGROUND OF THE INVENTION

1. Field of the Invention

The present invention relates to a flexible outdoor lighting stand and more particularly pertains to preventing the light stand of the light source from breaking when bent in any direction by an external force.

2. Description of the Prior Art

The use of outdoor lighting stand is known in the prior art. More specifically, outdoor lighting stands heretofore devised and utilized for the purpose of for lighting an outdoor area are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,337,993 to Hersman disclose a stake-based support system for use in the landscaping industry. U.S. Pat. No. 5,295,057 to Buonsante and Spector discloses a light on a stick. U.S. Pat. No. 5,176,443 to Lin discloses a flexible lighting fixture. U.S. Pat. No. 4,996,636 to Lovett discloses a low voltage light fixture. U.S. Pat. No. 4,774,648 to Kakukellson and Beachy discloses a low voltage light fixture. Lastly, U.S. Pat. No. Design 291,604 to Watson discloses an outdoor lighting fixture.

While these devices fulfill their respective, particular objectives and requirements, the aforementioned patents do not describe flexible outdoor lighting stand that allows a low voltage light source to be coupled with a flexible post having been secured onto a stake, whereby the flexible post prevents breakage of the light source support.

In this respect, the flexible outdoor lighting stand according to the present invention substantially departs from the conventional concepts and designs of the prior art, and in doing so provides an apparatus primarily developed for the purpose of preventing the light stand of the light source from breaking when bent in any direction by an external force.

Therefore, it can be appreciated that there exists a continuing need for a new and improved flexible outdoor lighting stand which can be used for preventing the light stand of the light source from breaking when bent in any direction by an external force. In this regard, the present invention substantially fulfills this need.

SUMMARY OF THE INVENTION

In view of the foregoing disadvantages inherent in the known types of outdoor lighting stands now present in the prior art, the present invention provides an improved flexible outdoor lighting stand. As such, the general purpose of the present invention, which will be described subsequently in greater detail, is to provide a new and improved flexible outdoor lighting stand and method which has all the advantages of the prior art and none of the disadvantages.

To attain this, the present invention essentially comprises a rigid stake member that has a tapered point at a lower end for piercing the ground. The stake member has a flat upper end. The stake member has a plurality of blades. The stake is a solid with a '+' cross section. The stake has a length of about 4½ inches and a diameter of about 2 inches. A generally cylindrical flexible post member is included. The post member has an upper sleeve, a lower sleeve and a spring member therebetween. The lower sleeve of the post member is positioned over the upper end of the stake member. The spring member is a heavy duty coil spring that is capable of maintaining an upright, position when the post member is positioned onto the stake. The post member has a length of about 3½ inches. Lastly, the upper sleeve of the post member has a threaded interior. The threaded interior is capable of coupling with a light source while the lower sleeve is positioned over the stake member. The light source is coupled to the post member prior to positioning the stake in the ground. The upper sleeve of the post member is capable of moving from side to side, when pressure is applied to the post member by an external force that causes the spring to bend.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved flexible outdoor lighting stand which has all of the advantages of the prior art outdoor lighting stands and none of the disadvantages.

It is another object of the present invention to provide a new and improved flexible outdoor lighting stand which may be easily and efficiently manufactured and marketed.

It is further object of the present invention to provide a new and improved flexible outdoor lighting stand which is of durable and reliable constructions.

An even further object of the present invention is to provide a new and improved flexible outdoor lighting stand which is susceptible of a low cost of manufacture with regard to both materials and labor, and which accordingly is then susceptible of low prices of sale to the consuming public, thereby making such flexible outdoor lighting stand economically available to the buying public.

Still yet another object of the present invention is to provide a new and improved flexible outdoor lighting stand which provides in the apparatuses and methods of the prior art some of the advantages thereof, while simultaneously overcoming some of the disadvantages normally associated therewith.

Even still another object of the present invention is to provide a flexible outdoor lighting stand for preventing the light stand of the light source from breaking when bent in any direction by an external force.

Lastly, it is an object of the present invention to provide a new and improved flexible outdoor lighting stand including a rigid stake member that has a tapered point at a lower end for piercing the ground and an upper end. A generally cylindrical flexible post member having a lower sleeve positionable over the upper end of the stake member. The post member has spring member coupled to the lower sleeve. The spring member has an upper sleeve coupled therewith. Lastly, the upper sleeve of the post member has a lighting adaptor capable of coupling with a light source when the lower sleeve is positioned over the stake member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various FIGURES.

DESCRIPTION OF THE PREFERRED EMBODIMENT

Figure 1:
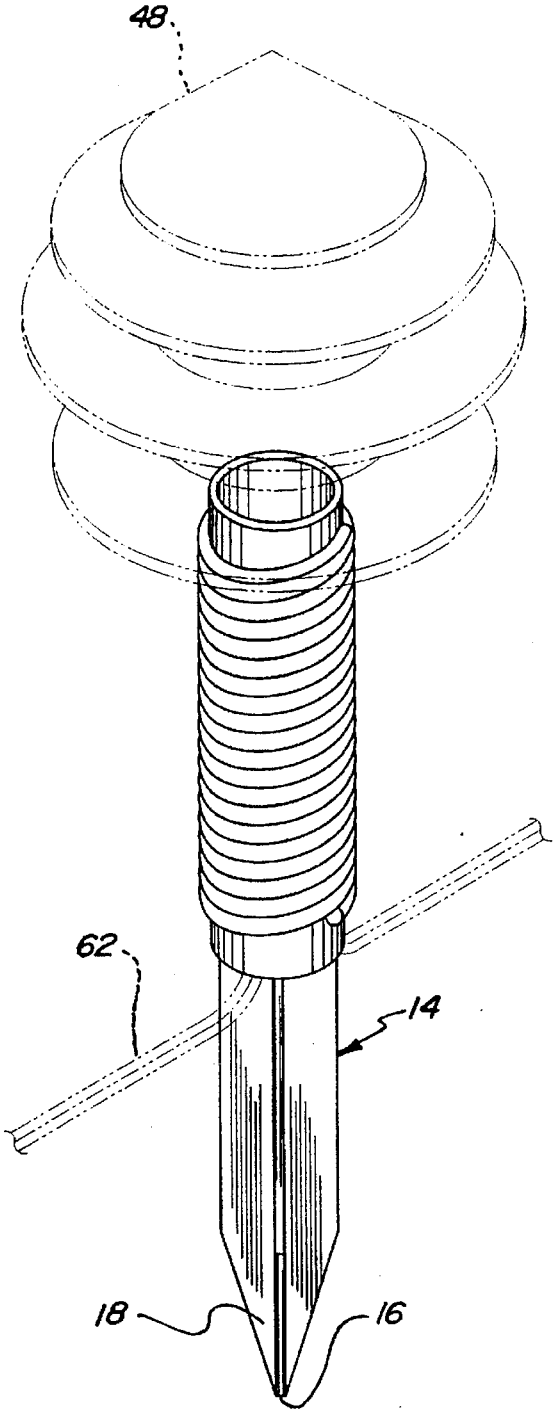
FIG. 1 is a perspective view of the preferred embodiment of the flexible outdoor lighting stand constructed in accordance with the principles of the present invention.
Figure 2:
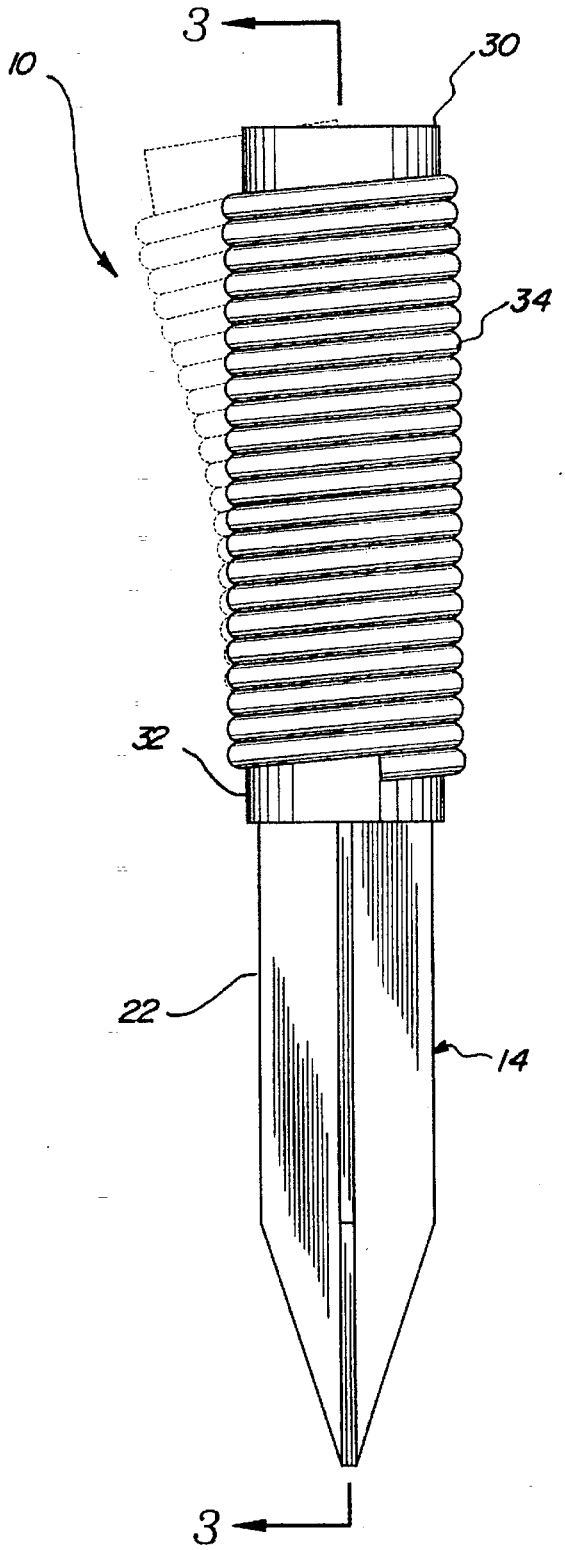
FIG. 2 is a side elevational view of the present invention indication movement of the post member.

With reference now to the drawings, and in particular to FIG. 1 thereof, the preferred embodiment of the new and improved flexible outdoor lighting stand embodying the principles and concepts of the present invention and generally designated by the reference numeral 10 will be described.

The present invention, the flexible outdoor lighting stand 10 is comprised of a plurality of components. Such components in their broadest context include a stake, a post and a spring. Such components are individually configured and correlated with respect to each other so as to attain the desired objective.

Figure 4:
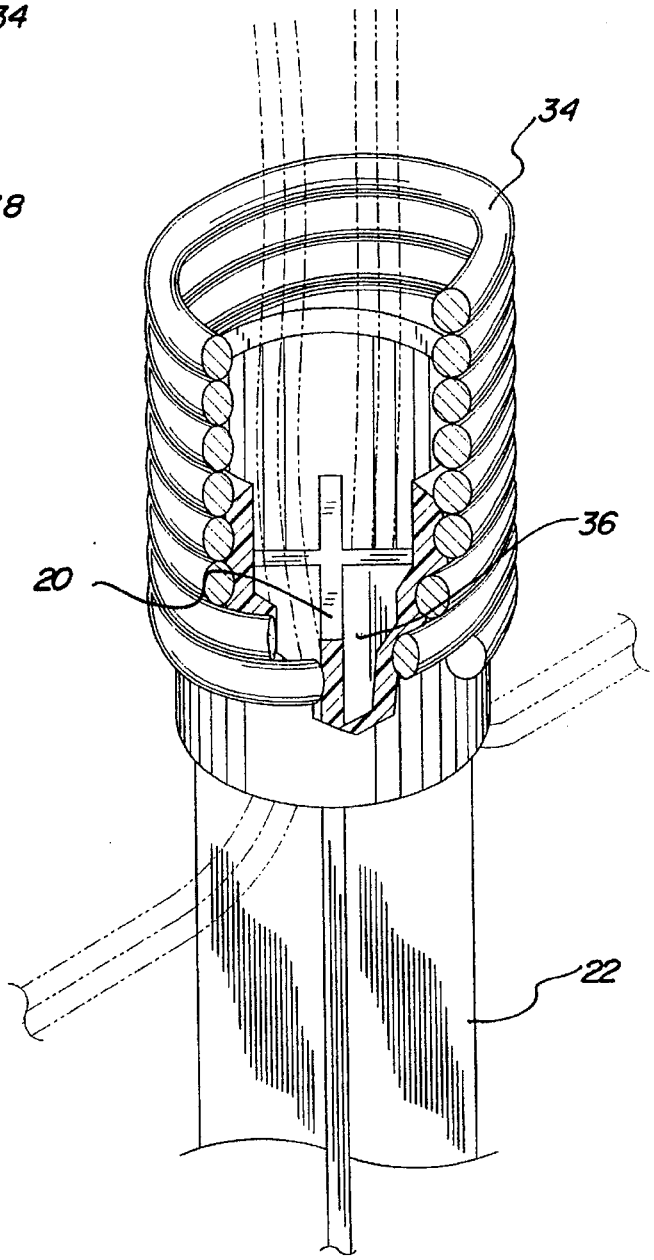
FIG. 4 is an enlarged cut-away view of the post member coupling to the stake member.

Specifically, the present invention includes a rigid stake member 14 that has a tapered point 16 at a lower end 18 for piercing the ground. The stake member has a flat upper end 20 as seen in FIG. 4. The stake member has a plurality of blades 22. The stake member is a solid with "+" cross section as seen in FIG. 4. The stake has a length of about 4½ inches and a diameter of about 2 inches. The stake, as seen in FIG. 1, is formed of a plastic resin that is used in making ground stakes currently on the market.

Figure 3:
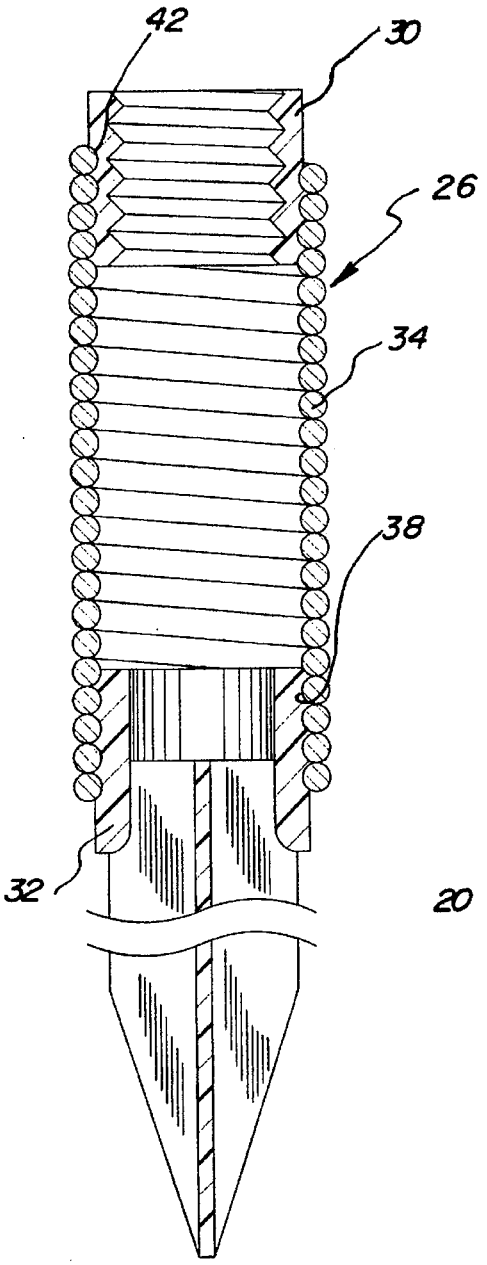
FIG. 3 is a cross sectional view of the present invention taken along line 3—3 of FIG. 2.

As best illustrated in FIG. 3, a generally cylindrical flexible post member 26 is provided. The post member is hollow. The post member has an upper sleeve 30, a lower sleeve 32 and a spring member 34 therebetween. The upper sleeve and the lower sleeve are formed of a plastic resin. The lower sleeve of the post member is positioned over the upper end of the stake member, as seen in FIG. 3. Positioning the post member over the stake forms four vertical channels 36. The spring member is a heavy duty coil spring formed of a metal or metal alloy. The spring is coupled over the outer wall 38 of the upper sleeve and the outer wall 42 of the lower sleeve. The spring is capable of maintaining an upright position when the post member is positioned onto the stake, and the stake is pushed into the ground. The post member has a length of about 3½ inches. The post member and the stake member, together, provide a lighting stand 10 that has a height of about 8 inches.

Figure 5:
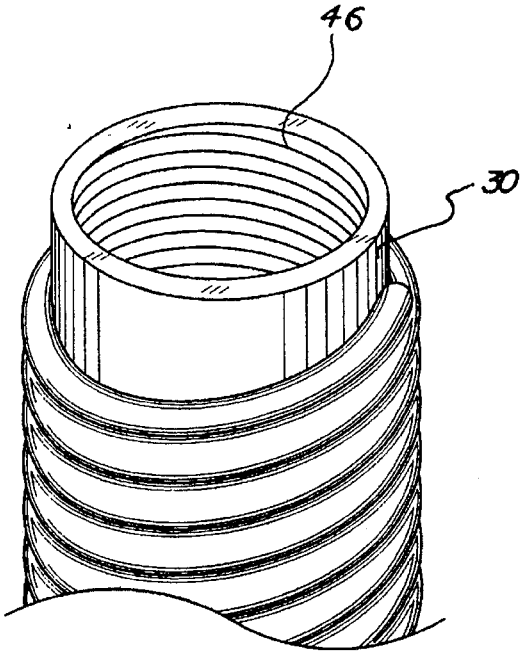
FIG. 5 is a isometric view of the threaded adaptor of the post member.
Figure 6:
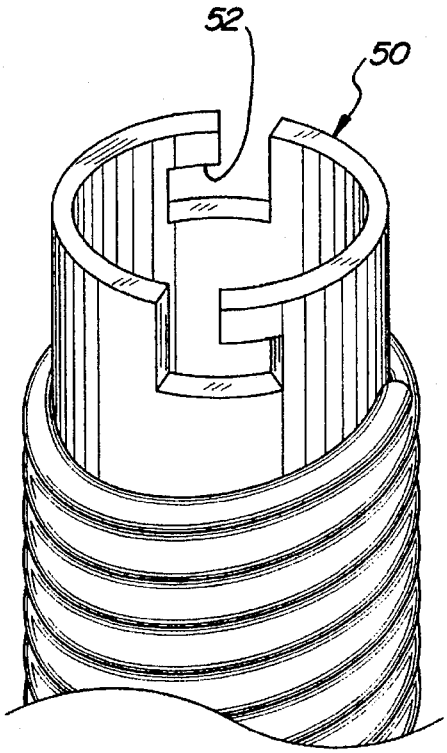
FIG. 6 is an isometric view of the bayonet socket of the post member.
Figure 7:
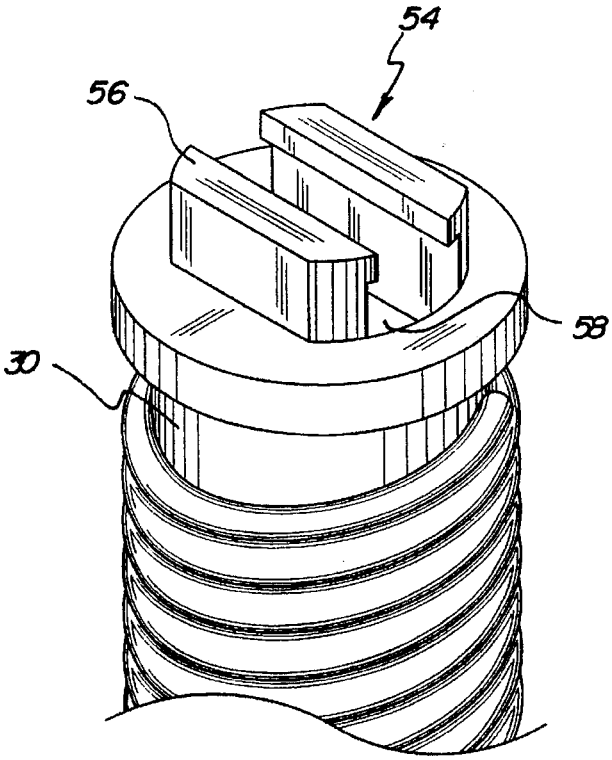
FIG. 7 is an isometric view of the prong-type coupler of the post member.

Lastly, the upper sleeve of the post member 26 has a lighting adaptor interconnected therewith. The lighting adaptor, as seen in FIGS. 3 and 5, has a threaded interior wall 46. The threaded interior wall is capable of coupling with a light source 48 while the lower sleeve is positioned over the stake member. The upper sleeve of the present invention is not limited to having the threaded interior wall as the only lighting adaptor. FIG. 6 shows the lighting adaptor as a bayonet socket 50. The bayonet socket and the upper sleeve are one piece. The bayonet socket, as seen in FIG. 6, has a pair of J-shaped slots 52 on opposite sides. The bayonet socket is capable of receiving the light source 48 having a bayonet coupling. Also, the light adaptor may be a prong-type coupler 54. The prong-type coupler has a pair of L-shaped coupler legs 56. As shown in FIG. 7, the L-shaped coupler of the legs face inward for snap fitting to the light source. The coupler legs have a channel 58 therebetween.

Furthermore, when the lighting source is coupled to the post member, the electrical source cable 62 passes into the post member, and out of the post member through any of the two vertical channels 36. The light source is coupled to the post member prior to positioning the stake member into the ground. The upper sleeve of the post member is capable of moving from side to side when pressure is applied thereto by an external force that causes the spring to bend. Whereby, the outdoor lighting stand is more durable and less likely to break from an external force being placed against the post member.

The present invention is a easy to use flexible outdoor lighting stand. The stand may be sold in sets of two or more. The stands are ground mounted exterior lighting stands. The post member of the stand is made of plastic upper sleeves and lower sleeves having a heavy duty spring between the two. The heavy duty spring allows the lighting stand to bend in any direction when external pressure is applied against it. Because the spring is part of the post member, it rebounds and returns to a 90 degree upright position after the external force has been removed. The present invention may be structure to have any number of lighting source adapters at the upper sleeve end. The post member is hollow and will allow the electrical cables of the low voltage lighting source to pass therethrough and exit where the post member and stake member couple. Bending of the post member at the spring does not interfere with the components of the low voltage lighting source at all. The present invention is economical saves the user's money over the life of the stand.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved flexible outdoor lighting stand comprising in combination:

a rigid stake member having a tapered point at a lower end for piercing the ground and a flat upper end, the stake member having a plurality of blades, the stake being a solid having a "+" cross section;

a generally cylindrical flexible post member, the post member having an upper sleeve, a lower sleeve and a spring member therebetween, the lower sleeve of the post member being positionable over the upper end of the stake member, the spring member being a heavy duty coil spring and capable of maintain an upright position when; and the upper sleeve of the post member having a threaded interior, the threaded interior being capable of coupling with a light source while the lower sleeve being positioned over the stake member, the light source coupled to the post member prior to positioning the stake member into the ground, the upper sleeve of the post member being capable of moving from side to side when pressure being applied thereto by an external force that causes the spring to bend.

2. The flexible outdoor lighting stand as set forth in claim 1, wherein the post member having a length of about 3½ inches and a diameter slightly greater than the diameter of the stake member for allowing the lower sleeve to slidably receive the stake member.

3. The flexible outdoor lighting stand as set forth in claim 1, including a lighting adapter with a prong-type coupler having a pair of L-shaped coupler legs facing inward for snap fitting to the light source.

4. The flexible outdoor lighting stand as set forth in claim 1, including a lighting adapter with a bayonet socket having a pair of J-shaped slots on opposite sides thereof, and capable of receiving the light source having a bayonet coupling.

5. The flexible outdoor lighting stand as set forth in claim 2, wherein the spring member being a heavy duty coil spring, the spring being capable of maintaining an upright position when the post member is positioned onto the stake member, and the spring being capable of bending from side to side while the post member remains coupled to the stake member.

* * * * *